US011772245B2

(12) United States Patent
Fischer et al.

(10) Patent No.: US 11,772,245 B2
(45) Date of Patent: Oct. 3, 2023

(54) IMPACT TOOL

(71) Applicant: MILWAUKEE ELECTRIC TOOL CORPORATION, Brookfield, WI (US)

(72) Inventors: Scott R. Fischer, Menomonee Falls, WI (US); Evan Brown, Milwaukee, WI (US); Maxwell A. Casper, Menomonee Falls, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 13 days.

(21) Appl. No.: 17/179,627

(22) Filed: Feb. 19, 2021

(65) Prior Publication Data

US 2021/0260733 A1 Aug. 26, 2021

Related U.S. Application Data

(60) Provisional application No. 62/980,698, filed on Feb. 24, 2020.

(51) Int. Cl.

| | |
|---|---|
| ***B25B 21/02*** | (2006.01) |
| ***B25B 23/18*** | (2006.01) |
| ***B25B 23/147*** | (2006.01) |

(52) U.S. Cl.

CPC ..... *B25B 21/023* (2013.01); *B25B 23/1475* (2013.01); *B25B 23/18* (2013.01)

(58) Field of Classification Search

CPC .... B25B 21/023; B25B 23/1475; B25B 23/18
See application file for complete search history.

(56) References Cited

U.S. PATENT DOCUMENTS 2,275,878 A 3/1942 Allenby
2,525,588 A 10/1950 Cameron et al.
(Continued)

FOREIGN PATENT DOCUMENTS

CA 2594441 C 8/2010
CN 101112757 B 5/2012
(Continued)

OTHER PUBLICATIONS

Bosch, "Power Tools for Professionals," <http://www.boschtools.com/Products/Tools/Pages/BoschProductDetail.aspx?pid=26618-01> web page publicly available at least as early as May 13, 2011, representative copy filed with IDS was captured Apr. 2021 (2 pages).

(Continued)

*Primary Examiner* — Andrew M Tecco
*Assistant Examiner* — Nicholas E Igbokwe
(74) *Attorney, Agent, or Firm* — Michael Best & Friedrich LLP

(57) ABSTRACT

An impact tool includes a housing having a motor housing portion and an impact housing portion, an electric motor supported in the motor housing, a battery pack supported by the housing for providing power to the motor; and a drive assembly supported by the impact housing portion. The drive assembly includes an anvil extending from the impact housing portion, a hammer that is both rotationally and axially movable relative to the anvil for imparting consecutive rotational impacts upon the anvil, and a spring for biasing the hammer in an axial direction toward the anvil. The impact tool further includes a boot covering the impact housing portion, a front retainer arranged on the boot, a plurality of lenses in the front retainer, a plurality of LEDs respectively arranged within one of the lenses, and a rear (Continued)

retainer arranged between the boot and the impact housing portion.

18 Claims, 4 Drawing Sheets

(56) References Cited

U.S. PATENT DOCUMENTS 2,852,051 A 9/1958 Bickner
3,904,178 A 9/1975 Scott et al.
4,833,782 A 5/1989 Smith
4,883,942 A 11/1989 Robak, Sr. et al.
4,973,205 A 11/1990 Spaulding
5,168,780 A 12/1992 Van Gennep
5,169,225 A 12/1992 Palm
5,267,129 A 11/1993 Anderson
5,369,555 A 11/1994 McKain et al.
5,445,479 A 8/1995 Hillinger
5,473,519 A 12/1995 McCallops et al.
5,525,842 A 6/1996 Leininger
5,793,130 A 8/1998 Anderson
5,797,670 A * 8/1998 Snoke ..... B25F 5/029 24/270
5,801,454 A 9/1998 Leininger
5,954,458 A 9/1999 Lee
5,982,059 A 11/1999 Anderson
6,095,659 A 8/2000 Hsu
RE36,917 E 10/2000 Leininger
6,168,287 B1 1/2001 Liu
6,206,538 B1 3/2001 Lemoine
6,318,874 B1 11/2001 Matsunaga
6,364,580 B1 4/2002 Dils et al.
6,443,675 B1 9/2002 Kopras et al.
6,494,590 B1 12/2002 Paganini et al.
6,502,949 B1 1/2003 Horiyama et al.
6,511,200 B2 1/2003 Matsunaga
6,565,227 B1 5/2003 Davis
6,575,590 B1 6/2003 Wadsworth
6,607,384 B1 8/2003 Nakanishi
6,713,904 B2 3/2004 Godkin
6,713,905 B2 3/2004 Hirschburger et al.
6,725,945 B2 4/2004 Sugimoto et al.
6,729,743 B2 5/2004 Gillette
6,814,461 B2 11/2004 Minalga
RE38,729 E 4/2005 Liu
6,874,921 B2 4/2005 Verlage et al.
6,886,961 B2 5/2005 Hara et al.
6,890,135 B2 5/2005 Kopras et al.
6,898,860 B2 5/2005 Wu
6,905,221 B2 6/2005 Hsu
6,910,783 B2 6/2005 Mezei et al.
6,964,545 B1 11/2005 Languasco
6,988,814 B1 1/2006 Correa
7,066,615 B2 6/2006 Diggle, III et al.
7,080,964 B2 7/2006 Riley et al.
7,093,951 B2 8/2006 Tsuruta et al.
7,101,058 B2 9/2006 Prell et al.
7,108,395 B2 9/2006 Correa
7,137,761 B2 11/2006 Hara
7,156,187 B1 1/2007 Townsan
7,185,998 B2 3/2007 Oomori et al.
7,200,516 B1 4/2007 Cowley
7,207,251 B2 4/2007 Ushiwata et al.
7,249,862 B2 7/2007 Shirane
7,253,541 B2 8/2007 Kovarik et al.
7,331,685 B2 2/2008 Shen et al.
7,343,841 B2 3/2008 Phillips et al.
7,357,526 B2 4/2008 Zeiler
7,367,254 B2 5/2008 Ushiwata et al.
7,377,202 B1 5/2008 Shibata
7,404,696 B2 7/2008 Campbell
7,498,526 B2 3/2009 Lohr et al.
7,521,892 B2 4/2009 Funabashi et al.
7,568,288 B2 8/2009 Baker
7,600,885 B2 10/2009 Canino et al.
7,677,752 B2 3/2010 Tadokoro et al.
7,732,747 B2 6/2010 Wieler et al.
7,815,356 B2 10/2010 Lutz et al.
7,824,136 B2 11/2010 Campbell
7,850,325 B2 12/2010 Wall et al.
7,871,177 B1 1/2011 Hanchett
7,878,090 B2 2/2011 Leupert
7,886,644 B2 2/2011 Ushiwata et al.
7,914,167 B2 3/2011 Petersen
7,918,030 B2 4/2011 Fukuoka
7,926,187 B2 4/2011 Uehlein-Proctor et al.
7,934,847 B2 5/2011 Oomori et al.
7,997,835 B2 8/2011 Whitehead et al.
8,016,048 B2 9/2011 Ueda et al.
8,042,966 B2 10/2011 Lutz et al.
8,069,572 B2 12/2011 Dreher
8,075,155 B2 12/2011 Watanabe et al.
8,091,650 B2 1/2012 Van der Linde et al.
8,128,250 B2 3/2012 Parrinello
8,316,548 B2 11/2012 Dreher
8,317,350 B2 11/2012 Friedman et al.
8,328,381 B2 12/2012 Dixon et al.
8,371,708 B2 2/2013 Nagasaka et al.
8,371,848 B2 2/2013 Okawa et al.
8,382,308 B2 2/2013 Hecht et al.
8,424,615 B2 4/2013 Baumann et al.
8,485,276 B2 7/2013 Wei
8,496,366 B2 7/2013 Leong
8,505,647 B2 8/2013 Kasuya et al.
8,506,108 B2 8/2013 Friedman et al.
8,517,558 B2 8/2013 Oomori et al.
8,529,084 B2 9/2013 Roehm
8,602,582 B2 12/2013 Parrinello
8,622,568 B2 1/2014 Koeder et al.
8,714,765 B2 5/2014 Miyazawa
8,763,721 B2 7/2014 Koeder et al.
8,783,378 B2 7/2014 Zhou
8,820,431 B2 9/2014 Puzio et al.
8,820,955 B2 9/2014 Dixon et al.
8,827,483 B2 9/2014 Dixon et al.
8,851,698 B2 10/2014 Parrinello
9,073,134 B2 7/2015 Koeder et al.
9,242,355 B2 1/2016 Sergyeyenko et al.
9,302,376 B2 4/2016 Agehara et al.
9,328,915 B2 5/2016 Vanko et al.
9,352,458 B2 5/2016 Friedman et al.
9,358,698 B2 6/2016 Karrar et al.
9,539,691 B2 1/2017 Hirschburger
9,573,257 B2 2/2017 Kynast et al.
9,682,466 B2 6/2017 Wessel
9,923,249 B2 3/2018 Rejman et al.
10,040,181 B2 8/2018 Fu et al.
10,052,733 B2 8/2018 Ely et al.
10,064,698 B2 9/2018 Zhang et al.
10,174,934 B2 1/2019 Padget et al.
2002/0054491 A1 5/2002 Casas
2002/0131267 A1 9/2002 Van Osenbruggen
2006/0104085 A1 5/2006 Walker et al.
2006/0262519 A1 11/2006 Hirschburger et al.
2006/0289595 A1 12/2006 Shen et al.
2007/0159812 A1 7/2007 Oomori et al.
2008/0074865 A1* 3/2008 Lutz ..... B25B 23/18 362/119
2008/0156163 A1 7/2008 Ushiwata et al.
2009/0080987 A1 3/2009 Canino et al.
2009/0114410 A1 5/2009 Van Der Linde et al.
2010/0038103 A1 2/2010 Ueda et al.
2010/0071921 A1 3/2010 Canino et al.
2010/0072833 A1 3/2010 Canino et al.
2010/0074700 A1 3/2010 Canino et al.
2010/0149790 A1* 6/2010 Leong ..... B25F 5/021 362/119
2010/0214768 A1 8/2010 Dixon et al.
2010/0277897 A1 11/2010 Hecht et al.
2011/0000689 A1 1/2011 Funabashi
2011/0037435 A1 2/2011 Funabashi
2011/0188232 A1* 8/2011 Friedman ..... H02K 16/005 362/119
2011/0199756 A1 8/2011 Oomori et al.

(56) References Cited

U.S. PATENT DOCUMENTS

| | | | | |
|---|---|---|---|---|
| 2012/0111592 | A1* | 5/2012 | Limberg | B25B 23/1405 173/48 |
| 2013/0003358 | A1* | 1/2013 | Friedman | B25F 5/02 362/119 |
| 2013/0301244 | A1* | 11/2013 | Friedman | B25B 21/00 362/119 |
| 2014/0190716 | A1 | 7/2014 | Sugiura et al. | |
| 2016/0121466 | A1 | 5/2016 | Kiyohara et al. | |
| 2016/0131353 | A1* | 5/2016 | Bartoszek | B25F 5/008 362/119 |
| 2017/0157753 | A1* | 6/2017 | Nagasaka | B23B 45/00 |
| 2019/0001457 | A1 | 1/2019 | Ely et al. | |
| 2019/0255687 | A1* | 8/2019 | Schneider | B25B 21/02 |

FOREIGN PATENT DOCUMENTS

| | | | |
|---|---|---|---|
| CN | 102431015 | A | 5/2012 |
| CN | 101482260 | B | 1/2013 |
| CN | 205437248 | U | 8/2016 |
| CN | 205938750 | U | 2/2017 |
| CN | 103906604 | B | 7/2017 |
| DE | 3525352 | A1 | 1/1987 |
| DE | 102011075663 | A1 | 11/2012 |
| DE | 102011077440 | A1 | 12/2012 |
| DE | 102012205274 | A1 | 10/2013 |
| EP | 1072842 | B1 | 9/2006 |
| EP | 1882553 | B1 | 9/2011 |
| EP | 2065141 | B1 | 6/2013 |
| EP | 2957369 | A1 | 12/2015 |
| EP | 3117964 | A1 | 1/2017 |
| EP | 3318366 | A1 | 5/2018 |
| GB | 2109727 | A | 6/1983 |
| GB | 2375497 | A | 11/2002 |
| JP | 5309508 | A | 11/1993 |
| JP | 6246645 | A | 9/1994 |
| JP | 10034565 | A | 2/1998 |
| JP | 10044064 | A | 2/1998 |
| JP | 11111002 | A | 4/1999 |
| JP | 2001057293 | A | 2/2001 |
| JP | 2002307326 | A | 10/2002 |
| JP | 2005040934 | A | 2/2005 |
| JP | 2019209443 | A | 12/2019 |
| WO | 2017097873 | A1 | 6/2017 |

OTHER PUBLICATIONS

Ryobi, "Ryobi 18 Volt Impact Driver Model No. P238 Repair Sheet," representative copy filed with IDS was available Dec. 4, 2018 (4 pages).

*Festo Corp.* v *Shoketsu Kinzoku Kogyo Kabushiki Co.*, 535 U.S. 722 (2002), decided May 28, 2002, (19 pages).

International Search Report and Written Opinion for Application No. PCT/US2021/018672 dated Jun. 8, 2021 (11 pages).

* cited by examiner

IMPACT TOOL

CROSS-REFERENCE TO RELATED APPLICATIONS

This application claims priority to U.S. Provisional Patent Application No. 62/980,698 filed on Feb. 24, 2020, the entire content of which is incorporated herein by reference.

FIELD OF THE INVENTION

The present invention relates to power tools, and more specifically to impact tools.

BACKGROUND OF THE INVENTION

Impact tools or wrenches are typically utilized to provide a striking rotational force, or intermittent applications of torque, to a tool element or workpiece (e.g., a fastener) to either tighten or loosen the fastener. As such, impact wrenches are typically used to loosen or remove stuck fasteners (e.g., an automobile lug nut on an axle stud) that are otherwise not removable or very difficult to remove using hand tools.

SUMMARY OF THE INVENTION

The present invention provides, in one aspect, an impact tool comprising a housing including a motor housing portion and an impact housing portion, an electric motor supported in the motor housing, a battery pack supported by the housing for providing power to the motor; and a drive assembly supported by the impact housing portion. The drive assembly is configured to convert a continuous rotational input from the motor to consecutive rotational impacts upon a workpiece. The drive assembly includes an anvil extending from the impact housing portion, a hammer that is both rotationally and axially movable relative to the anvil for imparting the consecutive rotational impacts upon the anvil, and a spring for biasing the hammer in an axial direction toward the anvil. The impact tool further comprises a boot covering the impact housing portion, a front retainer arranged on the boot, a plurality of lenses in the front retainer, and a plurality of LEDs. Each LED is respectively arranged within one of the lenses. The impact tool further comprises a rear retainer arranged between the boot and the impact housing portion. The rear retainer includes a portion that extends through the boot to which the front retainer is coupled.

The present invention provides, in another aspect, an impact tool comprising a housing including a motor housing portion and an impact housing portion, an electric motor supported in the motor housing, a battery pack supported by the housing for providing power to the motor, and a drive assembly supported by the impact housing portion. The drive assembly includes an anvil extending from the impact housing portion, and a hammer that is both rotationally and axially movable relative to the anvil for imparting consecutive rotational impacts upon the anvil. The impact tool further includes a boot covering the impact housing portion having an opening, a front retainer arranged on the boot, a plurality of lenses in the front retainer, a plurality of LEDs where each LED is respectively arranged within one of the lenses and mounted on a PCB, an LED control board at least partially located within the impact housing portion, and an electrical connector arranged in the front retainer. The electrical connector is configured to electrically connect at least one of the PCBs to the LED control board via a power wire extending from the electrical connector and the LED control board and through the opening in the boot. The impact tool further includes a rear retainer arranged between the boot and the impact housing portion having a groove, and the power wire extending to electrically connect the LEDs to the LED control board.

The present invention provides, in yet another aspect, a rotary power tool comprising a housing including an electric motor supported in the housing, a battery pack supported by the housing for providing power to the motor, and a drive assembly for transferring torque from the motor to an output member rotatably supported by the housing. The rotary power tool further includes a boot covering a portion of the housing, a front retainer arranged on the boot, a plurality of lenses radially mounted in the front retainer around the output member, and a plurality of LEDs where each LED is respectively arranged within one of the lenses and mounted on a PCB. The rotary power tool further includes a rear retainer arranged between the boot and the front portion of the housing having a threaded boss that extends through an aperture in the boot, and a fastener extending through the front retainer and received within the boss to from a threaded connection, which imparts a clamping force that is applied to the boot by the threaded connection.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
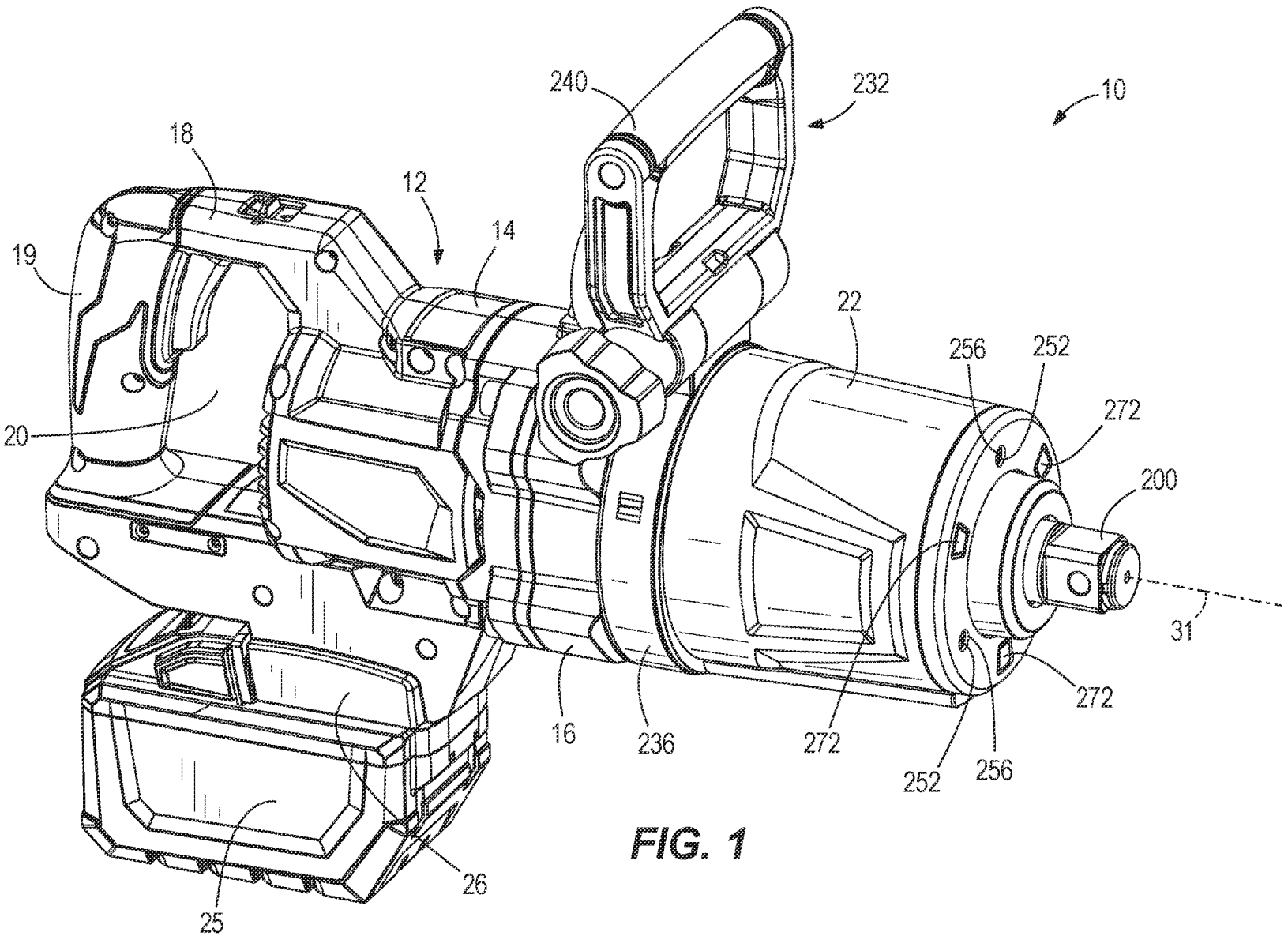
FIG. 1 is a perspective view of an impact wrench according to one embodiment.

FIG. 1 illustrates a rotary power tool in the form of an impact tool or impact wrench 10. The impact wrench 10 includes a housing 12 with a motor housing portion 14, an impact housing portion 16 coupled to the motor housing portion 14 (e.g., by a plurality of fasteners), and a generally D-shaped handle portion 18 disposed rearward of the motor housing portion 14. The handle portion 18 includes a grip 19 that can be grasped by a user operating the impact wrench 10. The grip 19 is spaced from the motor housing portion 14 such that an aperture 20 is defined between the grip 19 and the motor housing portion 14. In the illustrated embodiment, the handle portion 18 and the motor housing portion 14 are defined by cooperating clamshell halves, and the impact housing portion 16 is a unitary body. An elastomeric (e.g., rubber) boot 22 at least partially covers the impact housing portion 16 for protection. The boot 22 may be permanently affixed to the impact housing portion 16 or removable and replaceable.

With continued reference to FIG. 1, the impact wrench 10 includes a battery pack 25 removably coupled to a battery receptacle 26 on the housing 12. The battery pack 25 preferably has a nominal capacity of at least 5 Amp-hours (Ah) (e.g., with two strings of five series-connected battery cells (a "5S2P" pack)). In some embodiments, the battery pack 25 has a nominal capacity of at least 9 Ah (e.g., with three strings of five series-connected battery cells (a "5S3P pack"). The illustrated battery pack 25 has a nominal output voltage of at least 18 V. The battery pack 25 is rechargeable, and the cells may have a Lithium-based chemistry (e.g., Lithium, Lithium-ion, etc.) or any other suitable chemistry.

Figure 2:
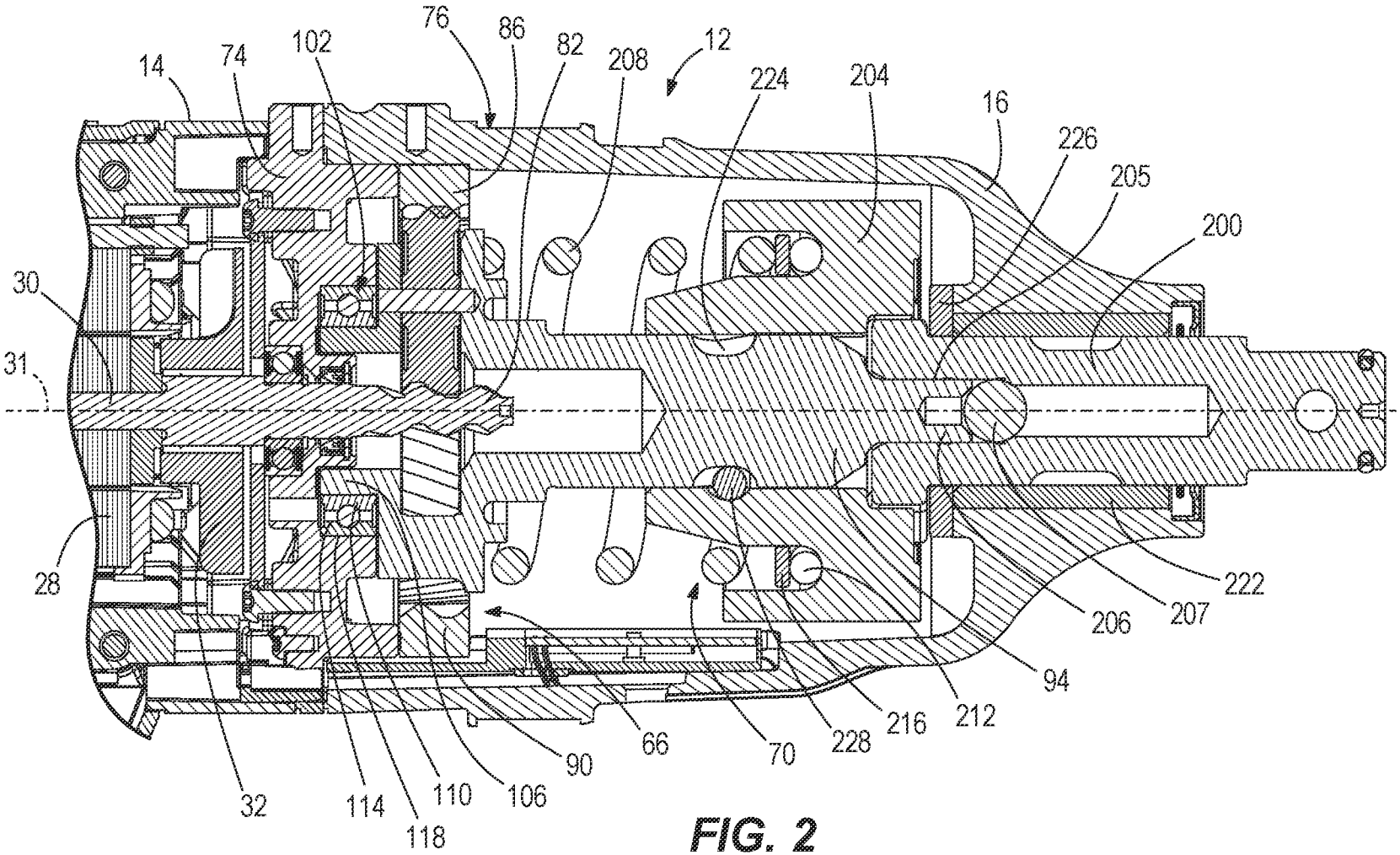
FIG. 2 is an enlarged, cross-sectional view of the impact wrench of FIG. 1, with portions removed.

Referring to FIG. 2, an electric motor 28, supported within the motor housing portion 14, receives power from the battery pack 25 (FIG. 1) when the battery pack 25 is coupled to the battery receptacle 26. The illustrated motor 28 is a brushless direct current ("BLDC") motor with a rotor or output shaft 30 that is rotatable about a motor axis 31. A fan 32 is coupled to the output shaft 30 (e.g., via a splined connection) adjacent a front end of the motor 28.

In some embodiments, the impact wrench 10 may include a power cord for electrically connecting the motor 28 to a source of AC power. As a further alternative, the impact wrench 10 may be configured to operate using a different power source (e.g., a pneumatic power source, etc.). The battery pack 25 is the preferred means for powering the impact wrench 10, however, because a cordless impact wrench advantageously requires less maintenance (e.g., no oiling of air lines or compressor motor) and can be used in locations where compressed air or other power sources are unavailable.

With reference to FIG. 2, the impact wrench 10 further includes a gear assembly 66 coupled to the motor output shaft 30 and a drive assembly 70 coupled to an output of the gear assembly 66. The gear assembly 66 is supported within the housing 12 by a support 74, which is coupled between the motor housing portion 14 and the impact housing portion 16 in the illustrated embodiment. The support 74 separates the interior of the motor housing portion 14 from the interior of the impact housing portion 16, and the support 74 and the impact housing portion 16 collectively define a gear case 76, with the support 74 defining the rear wall of the gear case 76. The gear assembly 66 may be configured in any of a number of different ways to provide a speed reduction between the output shaft 30 and an input of the drive assembly 70.

The illustrated gear assembly 66 includes a helical pinion 82 formed on the motor output shaft 30, a plurality of helical planet gears 86, and a helical ring gear 90. The output shaft 30 extends through the support 74 such that the pinion 82 is received between and meshed with the planet gears 86. The helical ring gear 90 surrounds and is meshed with the planet gears 86 and is rotationally fixed within the gear case 76 (e.g., via projections (not shown) on an exterior of the ring gear 90 cooperating with corresponding grooves (not shown) formed inside impact housing portion 16). The planet gears 86 are mounted on a camshaft 94 of the drive assembly 70 such that the camshaft 94 acts as a planet carrier for the planet gears 86.

Accordingly, rotation of the output shaft 30 rotates the planet gears 86, which then advance along the inner circumference of the ring gear 90 and thereby rotate the camshaft 94. In the illustrated embodiment, the gear assembly 66 provides a gear ratio from the output shaft 30 to the camshaft 94 between 10:1 and 14:1; however, the gear assembly 66 may be configured to provide other gear ratios.

With continued reference to FIG. 2, the camshaft 94 is rotationally supported at its rear end (i.e. the end closest to the motor 28) by a radial bearing 102. In particular, the camshaft 94 includes a bearing seat 106 between the planet gears 86 and the rear end of the camshaft 94. An inner race 110 of the bearing 102 is coupled to the bearing seat 106. An outer race 114 of the bearing 102 is coupled to a bearing retainer 118 formed in the support 74.

With continued reference to FIG. 2, the drive assembly 70 includes an anvil 200, extending from the impact housing portion 16, to which a tool element (e.g., a socket; not shown) can be coupled for performing work on a workpiece (e.g., a fastener). The drive assembly 70 is configured to convert the continuous rotational force or torque provided by the motor 28 and gear assembly 66 to a striking rotational force or intermittent applications of torque to the anvil 200 when the reaction torque on the anvil 200 (e.g., due to engagement between the tool element and a fastener being worked upon) exceeds a certain threshold. In the illustrated embodiment of the impact wrench 10, the drive assembly 66 includes the camshaft 94, a hammer 204 supported on and axially slidable relative to the camshaft 94, and the anvil 200.

The camshaft 94 includes a cylindrical projection 205 adjacent the front end of the camshaft 94. The cylindrical projection 205 is smaller in diameter than the remainder of the camshaft 94 and is received within a pilot bore 206 extending through the anvil 200 along the motor axis 32. The engagement between the cylindrical projection 205 and the pilot bore 206 rotationally and radially supports the front end of the camshaft 94. A ball bearing 207 is seated within the pilot bore 206. The cylindrical projection abuts the ball bearing 207, which acts as a thrust bearing to resist axial loads on the camshaft 94.

Thus, in the illustrated embodiment, the camshaft 94 is rotationally and radially supported at its rear end by the bearing 102 and at its front end by the anvil 200. Because the radial position of the planet gears 86 on the camshaft 94 is fixed, the position of the camshaft 94 sets the position of the planet gears 86. In the illustrated embodiment, the ring gear 90 is coupled to the impact housing portion 16 such that the ring gear 90 may move radially to a limited extent or "float" relative to the impact housing portion 16. This facilitates alignment between the planet gears 86 and the ring gear 90.

The drive assembly 70 further includes a spring 208 biasing the hammer 204 toward the front of the impact wrench 10 (i.e., in the right direction of FIG. 2). In other words, the spring 208 biases the hammer 204 in an axial direction toward the anvil 200, along the motor axis 32. A thrust bearing 212 and a thrust washer 216 are positioned between the spring 208 and the hammer 204. The thrust bearing 212 and the thrust washer 216 allow for the spring 208 and the camshaft 94 to continue to rotate relative to the hammer 204 after each impact strike when lugs (not shown) on the hammer 204 engage and impact corresponding anvil lugs to transfer kinetic energy from the hammer 204 to the anvil 200.

The camshaft 94 further includes cam grooves 224 in which corresponding cam balls 228 are received. The cam balls 228 are in driving engagement with the hammer 204 and movement of the cam balls 228 within the cam grooves 224 allows for relative axial movement of the hammer 204 along the camshaft 94 when the hammer lugs and the anvil lugs are engaged and the camshaft 94 continues to rotate. A bushing 222 is disposed within the impact housing 16 of the housing to rotationally support the anvil 200. A washer 226, which in some embodiments may be an integral flange portion of bushing 222, is located between the anvil 200 and a front end of the impact housing portion 16. In some embodiments, multiple washers 226 may be provided as a washer stack.

In operation of the impact wrench 10, an operator activates the motor 28 by depressing the trigger 21, which continuously drives the gear assembly 66 and the camshaft 94 via the output shaft 30. As the camshaft 94 rotates, the cam balls 228 drive the hammer 204 to co-rotate with the camshaft 94, and the hammer lugs engage, respectively, driven surfaces of the anvil lugs to provide an impact and to rotatably drive the anvil 200 and the tool element. After each impact, the hammer 204 moves or slides rearward along the camshaft 94, away from the anvil 200, so that the hammer lugs disengage the anvil lugs 220.

As the hammer 204 moves rearward, the cam balls 228 situated in the respective cam grooves 224 in the camshaft 94 move rearward in the cam grooves 224. The spring 208 stores some of the rearward energy of the hammer 204 to provide a return mechanism for the hammer 204. After the hammer lugs disengage the respective anvil lugs, the hammer 204 continues to rotate and moves or slides forwardly, toward the anvil 200, as the spring 208 releases its stored energy, until the drive surfaces of the hammer lugs re-engage the driven surfaces of the anvil lugs to cause another impact.

As shown in FIG. 1, the impact wrench 10 also includes an auxiliary handle assembly 232 including a collar 236 coupled to the impact housing portion 16 and a handle 240 pivotally coupled to the collar 236.

Figure 3:
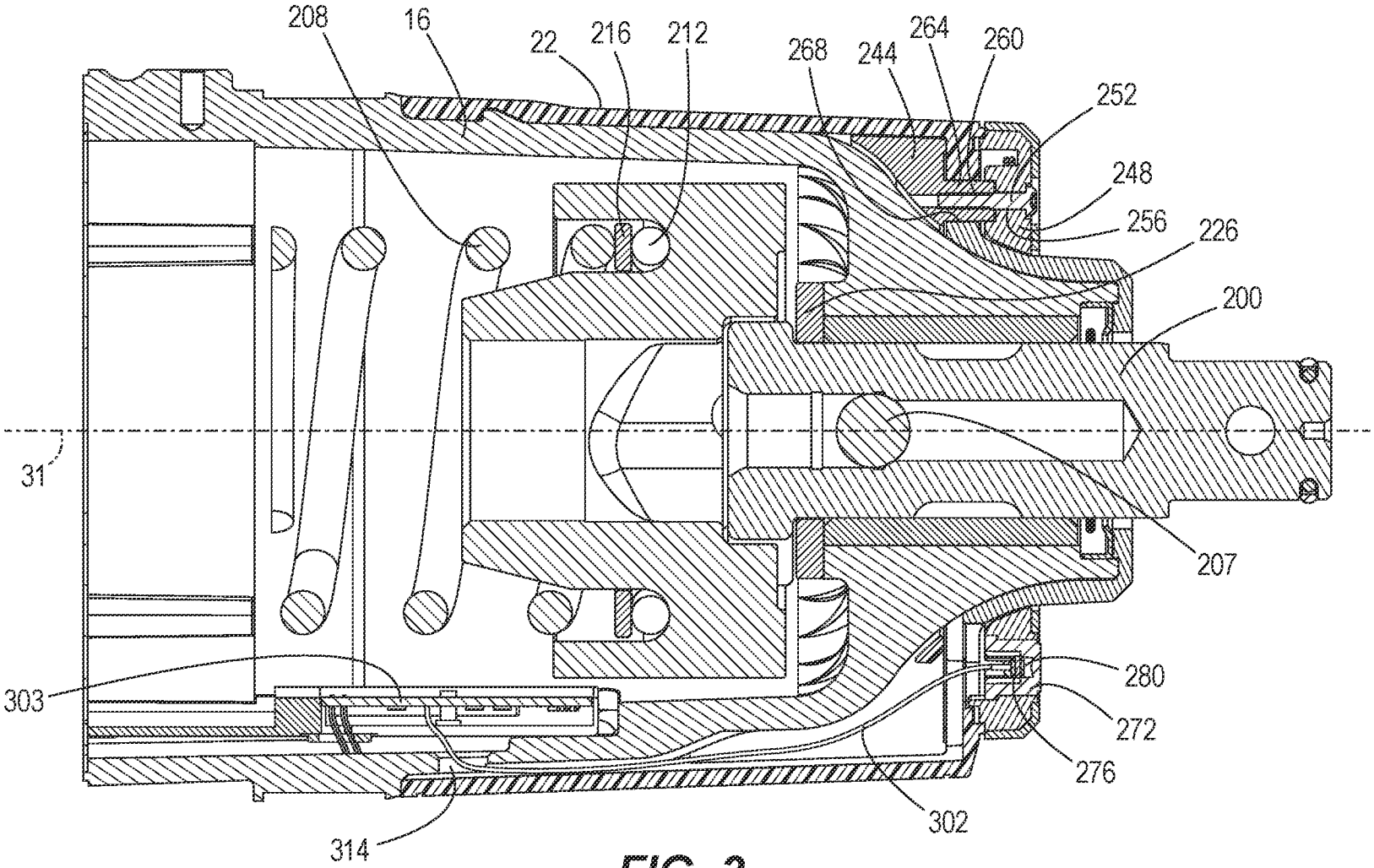
FIG. 3 is an enlarged, cross-sectional view of the impact wrench of FIG. 1, with portions removed.

As shown in FIG. 3, the impact wrench 10 further includes a rear retainer 244 arranged between the boot 22 and the impact housing 16, and a front retainer 248 arranged in front of the boot 22. The front retainer 248 is coupled to the rear retainer 244 via a plurality of fasteners 252 that respectively pass through a plurality of front bores 256 in the front retainer 248 and respectively into a plurality of threaded rear bores 260 within respective bosses 264 (FIG. 5) that forwardly project from the rear retainer 244 and extend through boot bores 268 (FIG. 3) of the boot 22. In this manner, the boot 22 is clamped between the rear retainer 244 and the front retainer 248.

Figure 4:
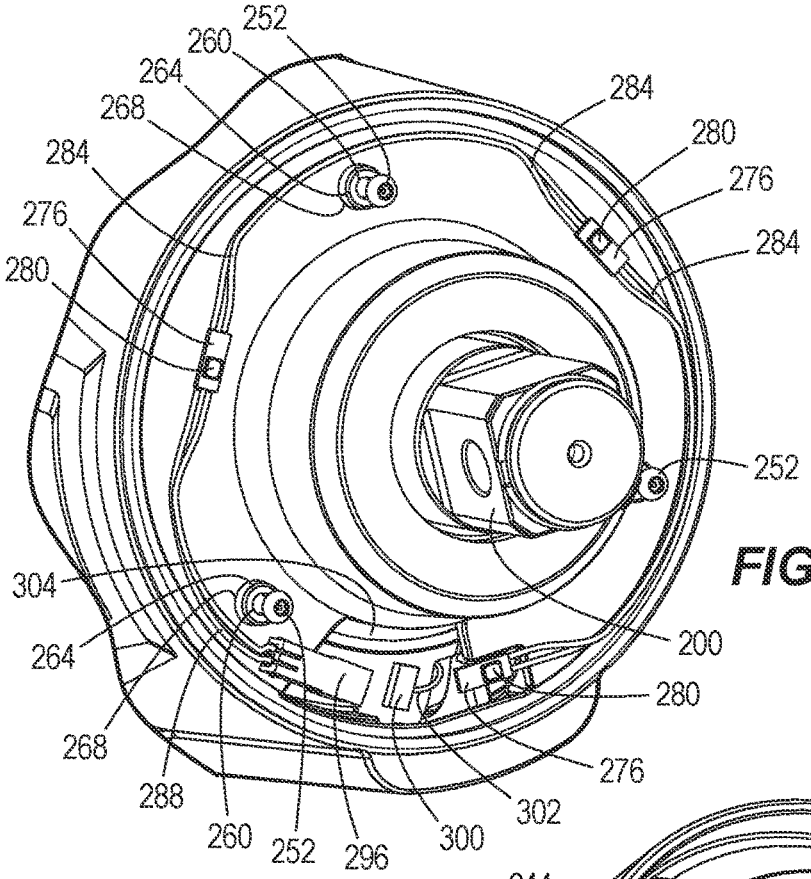
FIG. 4 is a perspective view of the impact wrench of FIG. 1, with portions removed.

The front retainer 248 includes a plurality of lenses 272 (FIGS. 1 and 3) disposed within corresponding apertures within the front retainer 248. The lenses 272 respectively cover and retain a plurality of printed circuit boards (PCBs) 276 on which a plurality of light-emitting diodes (LEDs) 280 (FIG. 5) are respectively are mounted (FIG. 4). In the illustrated embodiment, the LEDs 280 are surface-mounted LEDs. In the illustrated embodiment, there are three LEDs 280 respectively arranged on three PCBs 276 but in other embodiments, there can be more or fewer LEDs 280 and PCBs 276. The arrangement of the LEDs 280 and lenses 272 around the anvil 200 allow a fastener to be illuminated in a shadowless manner during operation. As shown in FIG. 4, each of the PCBs 276 is electrically connected to at least one other PCB 276 by a set of intermediate wires 284 respectively arranged between each pair of electrically coupled PCBs 276.

Figure 5:
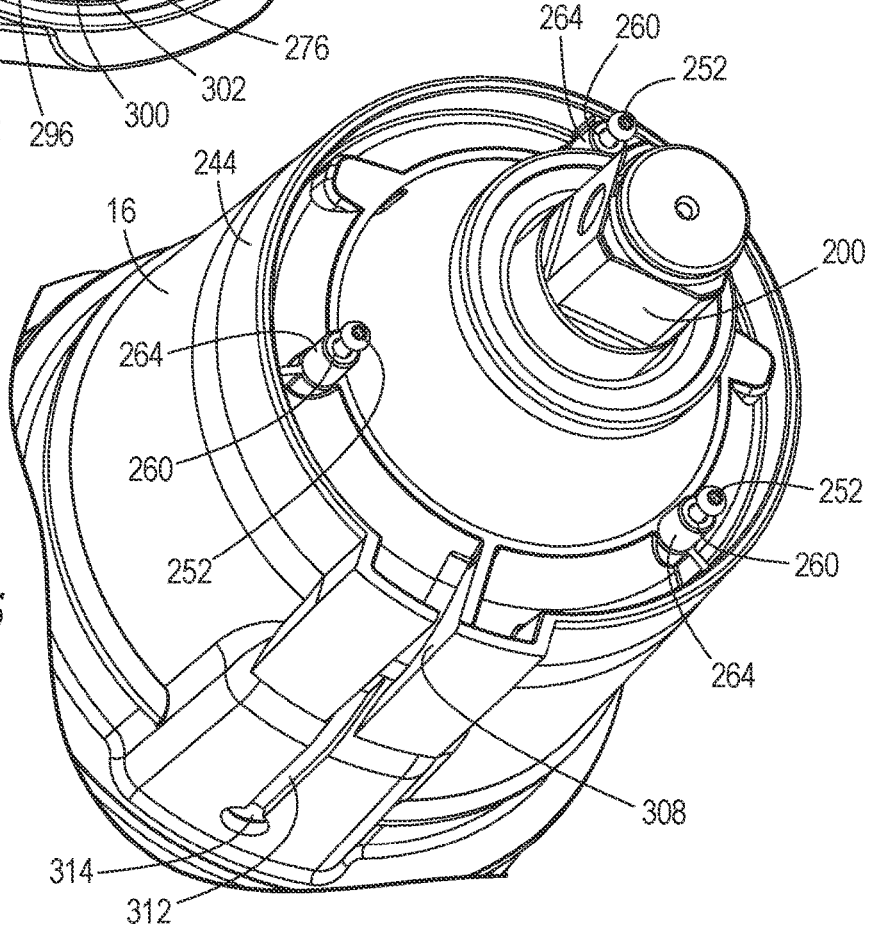
FIG. 5 is a perspective view of the impact wrench of FIG. 1, with portions removed.

As shown in FIG. 4, a connector wire 288 extends from one of the PCBs 276 to a first electrical connector 296 arranged in the front retainer 248 and configured to be coupled to a second electrical connector 300. A power transmission wire 302 extends from the second electrical connector 300 to an LED control board 303 in the impact housing portion 16 (FIG. 3), such that the power transmission wire 302 can transmit electrical current from the LED control board 303 to the LEDs 280. As shown in FIG. 4, in which the front retainer 248 is removed, the boot 22 includes a front opening 304. As shown in FIG. 5, in which both the front retainer 248 and boot 22 are removed, the rear retainer 244 includes a slot 308, and the impact housing portion 16 includes a groove 312 aligned with the slot 308 and a hole 314 communicating the groove 312 with the interior of the impact housing portion 16. Thus, the power transmission wire 302 extends from the second electrical connector 300, through the front opening 304 of the boot 22, through the slot 308 in the rear retainer 244, through the groove 312 and the hole 314 in the impact housing 16, to the LED control board 303.

Various features of the invention are set forth in the following claims.

What is claimed is:

1. An impact tool comprising:

a housing including a motor housing portion and an impact housing portion;

an electric motor supported in the motor housing;

a battery pack supported by the housing for providing power to the motor;

a drive assembly supported by the impact housing portion, the drive assembly configured to convert a continuous rotational input from the motor to consecutive rotational impacts upon a workpiece, the drive assembly including an anvil extending from the impact housing portion, a hammer that is both rotationally and axially movable relative to the anvil for imparting the consecutive rotational impacts upon the anvil, and a spring for biasing the hammer in an axial direction toward the anvil;

a boot covering the impact housing portion;

a front retainer arranged on the boot;

a plurality of lenses in the front retainer;

a plurality of LEDs, each LED respectively arranged within one of the lenses;

an LED control board at least partially located within the impact housing portion; and a rear retainer arranged between the boot and the impact housing portion, the rear retainer including a portion that extends through the boot to which the front retainer is coupled, wherein the impact housing portion includes a groove aligned with a slot in the rear retainer and a hole communicating the groove with an interior of the impact housing portion, and wherein the power wire extends through the groove and the hole in the impact housing portion.

2. The impact tool of claim 1, further comprising a fastener extending from the front retainer to the portion of the rear retainer extending through the boot.

3. The impact tool of claim 2, wherein the portion of the rear retainer extending through the boot is configured as a boss, wherein the fastener is a threaded fastener that is received within a threaded bore in the boss to form a threaded connection, and wherein a clamping force is applied to the boot by the threaded connection.

4. The impact tool of claim 1, wherein the boot includes an opening, and wherein the impact tool further comprises an electrical connector arranged in the front retainer and a power wire extending from the electrical connector, through the opening and the slot, to the LED control board.

5. The impact tool of claim 1, further comprising a plurality of PCBs upon which the LEDs are respectively mounted, and an intermediate wire electrically connecting at least two of the PCBs.

6. The impact tool of claim 5, wherein the lenses are configured to respectively cover and retain the PCBs and the LEDs to the front retainer.

7. The impact tool of claim 5, wherein the intermediate wire is a set of intermediate wires arranged between two of the PCBs.

8. The impact tool of claim 1, wherein the LEDs are radially mounted in the front retainer around the anvil.

9. An impact tool comprising:

a housing including a motor housing portion and an impact housing portion;

an electric motor supported in the motor housing portion;

a drive assembly supported by the impact housing portion, the drive assembly including an anvil extending from the impact housing portion, and a hammer that is both rotationally and axially movable relative to the anvil for imparting consecutive rotational impacts upon the anvil, a battery pack supported by the housing for providing power to the motor; and a boot covering the impact housing portion including an opening;

a front retainer arranged on the boot;

a plurality of lenses in the front retainer;

a plurality of LEDs, each LED respectively arranged within one of the lenses and mounted on a PCB;

an LED control board at least partially located within the impact housing portion;

an electrical connector arranged in the front retainer, the electrical connector configured to electrically connect at least one of the PCBs to the LED control board via a power wire extending between the electrical connector and the LED control board, and through the opening in the boot; and a rear retainer arranged between the boot and the impact housing portion, wherein the rear retainer includes a groove through which the power wire extends to electrically connect the LEDs to the LED control board.

10. The impact tool of claim 9, wherein the rear retainer includes a portion that extends through the boot to which the front retainer is coupled.

11. The impact tool of claim 10, further comprising a fastener extending through the front retainer and received within the portion of the rear retainer extending through the boot.

12. The impact tool of claim 11, wherein the portion of the rear retainer extending through the boot is configured as a boss, wherein the fastener is a threaded fastener that is received within a threaded bore in the boss to form a threaded connection, and wherein a clamping force is applied to the boot by the threaded connection.

13. The impact tool of claim 9, wherein the lenses are configured to respectively cover and retain the PCBs and the LEDs to the front retainer.

14. The impact tool of claim 9, wherein the LEDs are radially mounted in the front retainer around the anvil.

15. The impact tool of claim 9, wherein at least two of the PCBs are electrically connected to each other by a set of intermediate wires.

16. A rotary power tool comprising:

a housing;

an electric motor supported in the housing;

a battery pack supported by the housing for providing power to the motor;

a drive assembly for transferring torque from the motor to an output member rotatably supported by the housing;

a boot covering a front portion of the housing;

a front retainer arranged on the boot;

a plurality of lenses radially mounted in the front retainer around the output member;

a plurality of LEDs, each LED respectively arranged within one of the lenses and mounted on a PCB;

a rear retainer arranged between the boot and the front portion of the housing, the rear retainer including a threaded boss that extends through an aperture in the boot; and a fastener extending through the front retainer and received within the boss to form a threaded connection, wherein a clamping force is applied to the boot by the threaded connection, wherein the boot includes an opening and the rear retainer includes a groove, and wherein the rotary power tool further comprises an electrical connector arranged in the front retainer and a power wire extending from the electrical connector, through the opening and the groove, to an LED control board of the rotary power tool.

17. The rotary power tool of claim 16, wherein at least two of the PCBs are electrically connected to each other by a set of intermediate wires.

18. The rotary power tool of claim 17, wherein the clamping force applied to the boot by the threaded connection is configured to secure the set of intermediate wires between the rear retainer and the boot.

* * * * *